United States Patent [19]

Holsten et al.

[11] Patent Number: 4,974,283

[45] Date of Patent: Dec. 4, 1990

[54] HAND-GUIDED SWEEPING MACHINE

[75] Inventors: Heinz Holsten, Fintel; Joachim Bahnemann, Bad Oldesloe, both of Fed. Rep. of Germany

[73] Assignee: Hako-Werke GmbH & Co., Bad Oldesloe, Fed. Rep. of Germany

[21] Appl. No.: 285,042

[22] Filed: Dec. 15, 1988

[30] Foreign Application Priority Data

Dec. 16, 1987 [EP] European Pat. Off. ..... 87118653.2

[51] Int. Cl.[5] ..... A47L 9/20; A47L 9/10

[52] U.S. Cl. ..... 15/349; 15/79 A; 15/83

[58] Field of Search ..... 15/349, 79 A, 83, 359

[56] References Cited

U.S. PATENT DOCUMENTS

| | | | |
|---|---|---|---|
| 2,702,377 | 2/1955 | Luksch et al. | 15/349 X |
| 2,784,440 | 3/1957 | Newport | 15/83 X |
| 2,972,159 | 2/1901 | Swanson et al. . | |
| 3,189,931 | 6/1965 | Peabody . | |
| 3,813,725 | 6/1974 | Rinker | 15/347 |
| 3,879,789 | 4/1975 | Kasper . | |
| 3,942,215 | 3/1976 | Olds . | |
| 4,327,455 | 5/1982 | Burgoon | 15/83 |
| 4,580,313 | 4/1986 | Blehert . | |

*Primary Examiner*—Frankie L. Stinson

*Attorney, Agent, or Firm*—Foley & Lardner

[57] ABSTRACT

A hand-guided sweeping machine has a filter housing pivotally mounted to tilt about an axis to facilitate shaking the filter free of dust. The filter housing outlet is in sealing registry with the blower intake when the housing is lowered, and is moved out of sealing registry when the housing is raised. In the raised position, the filter housing covers the hopper opening so that debris from the filter housing will continue to fall into the hopper. A flap-like sealing arrangement surrounds the filter housing inlet to prevent dust from entering the internal mechanism of the sweeper.

19 Claims, 7 Drawing Sheets

HAND-GUIDED SWEEPING MACHINE

BACKGROUND OF THE INVENTION

1. Field of the Invention

The present invention relates to hand-guided sweeping machines, and, particularly, to sweeping machines of the type employing a rotary-driven cylindrical brush to propel debris into a detachable hopper, a blower (fan) for drawing a suction airstream through the machine to facilitate pickup of dust, and a filter disposed to remove dust from the airstream prior to passing through the blower.

2. Description of the Prior Art

In general, hand-guided sweeping machines including a hopper disposed to receive debris propelled by a rotary-driven cylindrical brush, a fan for drawing a suction airstream through the hopper and a filter disposed above the hopper, are known. In such sweepers, particles collected by the filter fall or may be shaken down into a receptacle.

An example of such a prior art sweeper is described in U.S. Pat. No. 3,189,931, issued on June 22, 1965 to R. C. Peabody. In that sweeper, a filter housing is integrally attached to the hopper. When the hopper is to be emptied, the receptacle and filter housing are manipulated as a unit and moved out of proximity with the inlet to the blower.

Another example of a prior art sweeper is described in U.S. Pat. No. 4,580,313, issued on April 8, 1986 to M. L. Blehert. Such prior art sweepers employ a box-shaped filter housing disposed immediately above the hopper. The lower wall of the housing is sloped downwardly and forwardly to communicate at its forward end with the hopper. The filter housing is hingedly secured at its rear upper end to the frame of the sweeper in proximity to the blower inlet, and is freely, but sealingly, engaged at its front lower end with the hopper. The filter housing may be pivoted upward into a raised position to permit the hopper to be tipped for emptying or removed from the sweeper. The filter housing cooperates with a vibrator to shake collected dust particles from the filter and convey the dust along a sloped lower wall of the housing into the hopper.

Such prior art sweepers, however, are disadvantageous in that they tend to be unwieldly, or relatively expensive, and tend to be susceptible to dust entering the blower mechanism when the filter housing is removed or raised to empty the hopper. Further, in the case of the prior art sweepers employing a hinged filter housing, the housing inlet is removed from registry with the hopper opening. Accordingly, dust from the filter shaken loose when the housing is tilted is not collected in the hopper, but rather tends to disburse over the surrounding area, and internal components of the sweeping machine.

SUMMARY OF THE INVENTION

The present invention provides a hand-guided sweeping machine of relatively simple construction which permits shaking the filter free of dust, without permitting dust to escape during the shaking processes and enter the internal mechanism of the sweeper.

In accordance with one aspect of the present invention, the filter housing is pivotally mounted to tilt about an axis at the opposite side of the hopper from the blower, preferably with the axis disposed at a height closer to the center of the inlet opening of the filter housing (communicating with the hopper) than to the center of the outlet opening (communicating with the blower). When the housing is in its lowered position, the filter housing outlet is in sealing registry with the blower intake, and in the raised position is moved out of registry with the blower intake, interrupting the air flow through the filter. Even in the raised position, the filter housing covers the opening to the hopper so that debris from the filter housing continues to fall into the debris hopper.

In accordance with another aspect of the present invention, to prevent dirt from entering the sweeper mechanism when the filter housing is in a raised position, a flap-like sealing arrangement surrounding the filter housing inlet opening is provided.

DESCRIPTION OF THE DRAWINGS

A preferred exemplary embodiment will hereinafter be described in conjunction with the appended drawing wherein like numbers denote like elements and.

In various of the Figures, elements are omitted or shown only in schematic form for ease of illustration and clarity.

DETAILED DESCRIPTION OF THE PREFERRED EXEMPLARY EMBODIMENT

Figure 1:
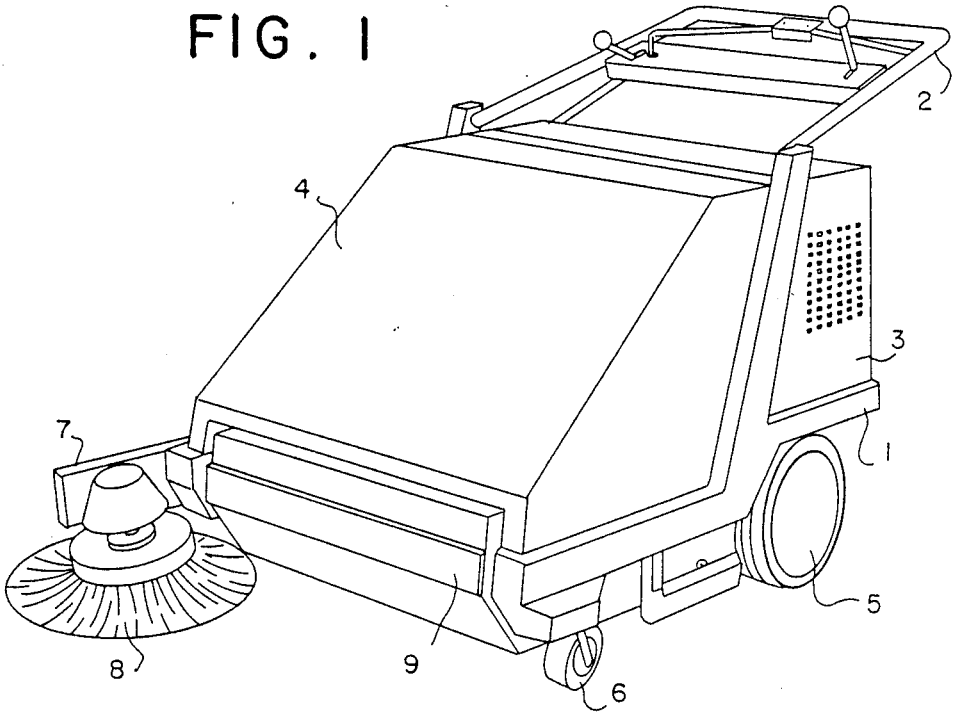
FIG. 1 is a perspective view of a hand-guided sweeping machine according to the invention.
Figure 2:
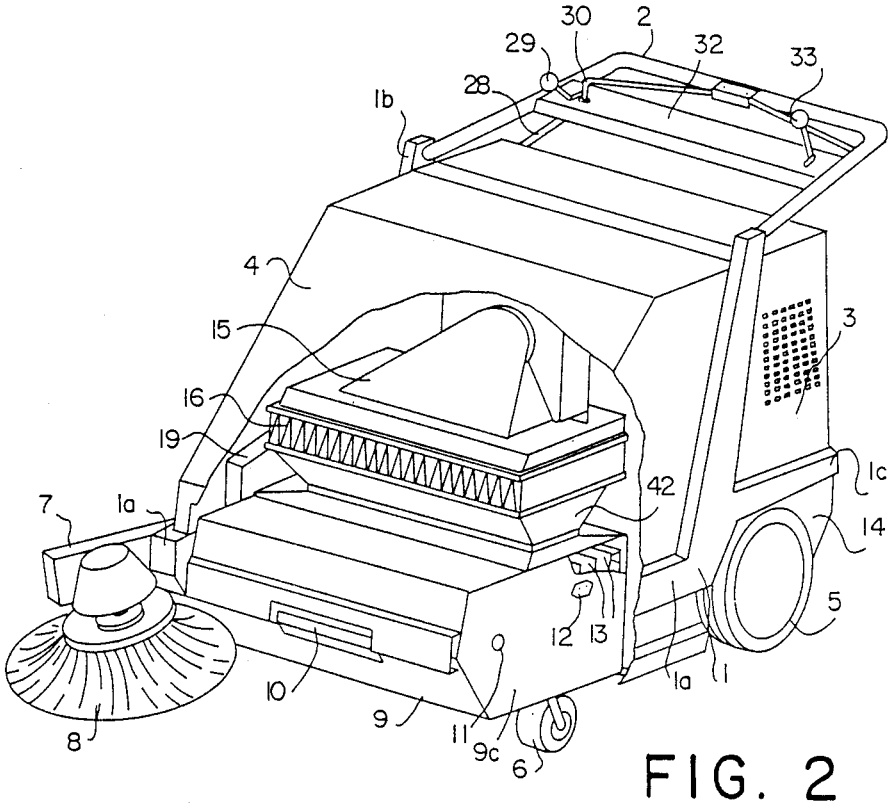
FIG. 2 is a partly cut-away and simplified perspective view of the hand-guided sweeping machine of FIG. 1.
Figure 6:
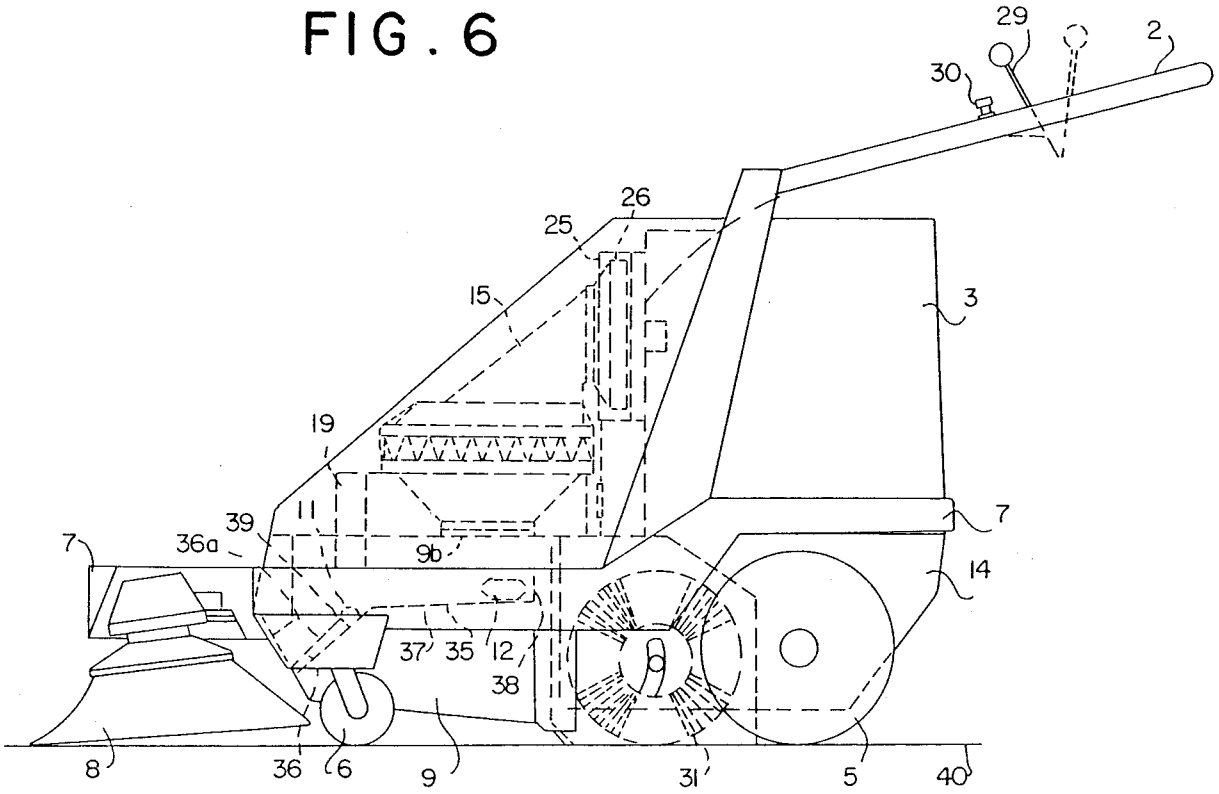
FIG. 6 is a more complete schematic side view of the sweeping machine of FIGS. 1 and 2, showing, inter alia, a guide and mount for the dirt hopper.

Referring now to FIGS. 1, 2 and 6, a handguided sweeping machine 100 in accordance with the present invention, includes a machine frame 1, a detachable hopper 9, a filter housing 15, a blower housing 25, a blower 26 and a rotatable cylindrical brush 31. Frame 1 is also provided with respective pairs of wheels 5 and 6 (attached to frame 1 in a conventional manner, not shown) and supports a suitable drive mechanism (not shown), such as a conventional battery-driven electric motor or an internal combustion engine, disposed within a drive housing 3. In addition, a removable cover lid 4 is disposed on frame 1 over hopper 9, filter housing 15, blower housing 25. An undercasing 14 is suitably mounted on frame 1 inwardly of wheels 5 to cover the back, front and sides of cylindrical brush 31. If desired, a conventional rotating disk broom 8 may be provided at the front of sweeping machine 100 on a swingable arm 7.

Frame 1 suitably includes respective generally horizontal forward support members 1*a*, vertical columns 1*b*, and generally horizontal rear supports 1*c*. Forward support members 1*a* are each provided with a slide track 35 (FIG. 6; not shown in FIGS. 1 and 2), a generally vertical support member 19 and a strut 21 (FIG. 6). As will hereinafter be more fully described, hopper 9 includes respective pairs of oppositely directed projections 11 and 12 which cooperate with tracks 35 and are removably received between forward support members 1*a*. Vertical supports 19 extend a predetermined height above the top of hopper 9, when hopper 9 is in place on tracks 35.

A handlebar 2, by which the operator guides sweeper 100, is affixed to the upper portion of vertical columns 1*b* , extending to the rear of sweeper 100. A cross strut 32 is provided across handlebar 2 in which respective control devices, such as a filter tilt control lever 29, a main drive switch 30, and a direction control lever 33, are mounted.

Figure 3:
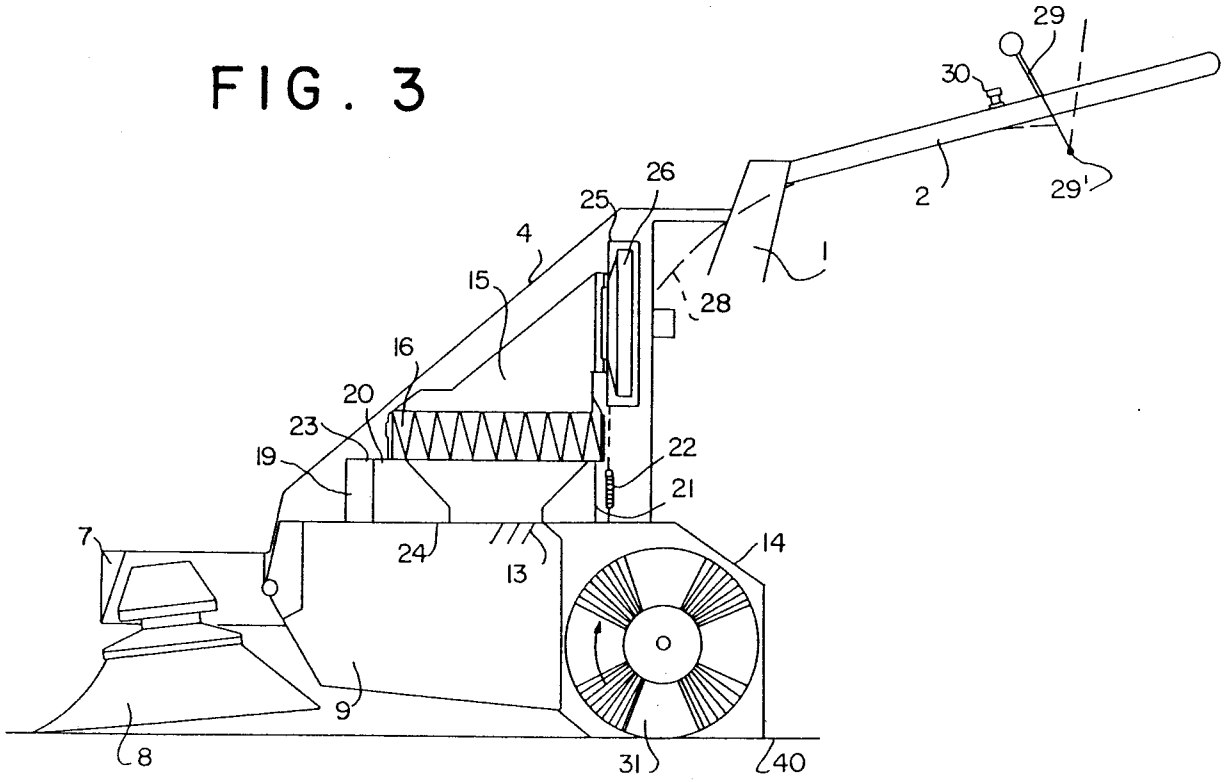
FIG. 3 is a simplified schematic side view of the sweeping machine of FIGS. 1 and 2, with the filter housing in its lowered position.

Referring briefly to FIGS. 2, 3, 6 and 7, hopper 9 is preferably generally box-shaped and includes a relatively large rear aperture (opening) 9*a*, and an upper opening 9*b* (FIGS. 3 and 6). Respective spaced apart guideplates 13 (FIGS. 2 and 3) extend across upper opening 9*b*. Plates 13 are generally rectangular in shape and are inclined downwardly towards the front of hopper 9 for directing dirt therein. Pairs of respective forward and rear projections 11 and 12 are provided on the vertical sidewalls 9*c* of hopper 9, adapted to cooperate with tracks 35, to facilitate mounting. Projections 11 are generally cylindrical and have a predetermined diameter. Projections 11 are disposed on sidewalls 9*c* at predetermined distances from the front and bottom of hopper 9. Projections 12 are generally elliptical in cross section, and are larger in cross section than projections 11. Projections 12 are disposed at predetermined distances from the rear and bottom of hopper 9, somewhat higher than projections 11. If desired, a handle 10 may be provided in the front wall of hopper 9 to facilitate insertion and removal. When fully inserted along tracks 35, hopper 9 is disposed with rear opening 9*a* proximate to cylindrical brush 31. Rear opening 9*a* may include a flap 57 which trails along the ground and ensures that dirt and dust are swept up by brush 31 into hopper 9.

Figure 4:
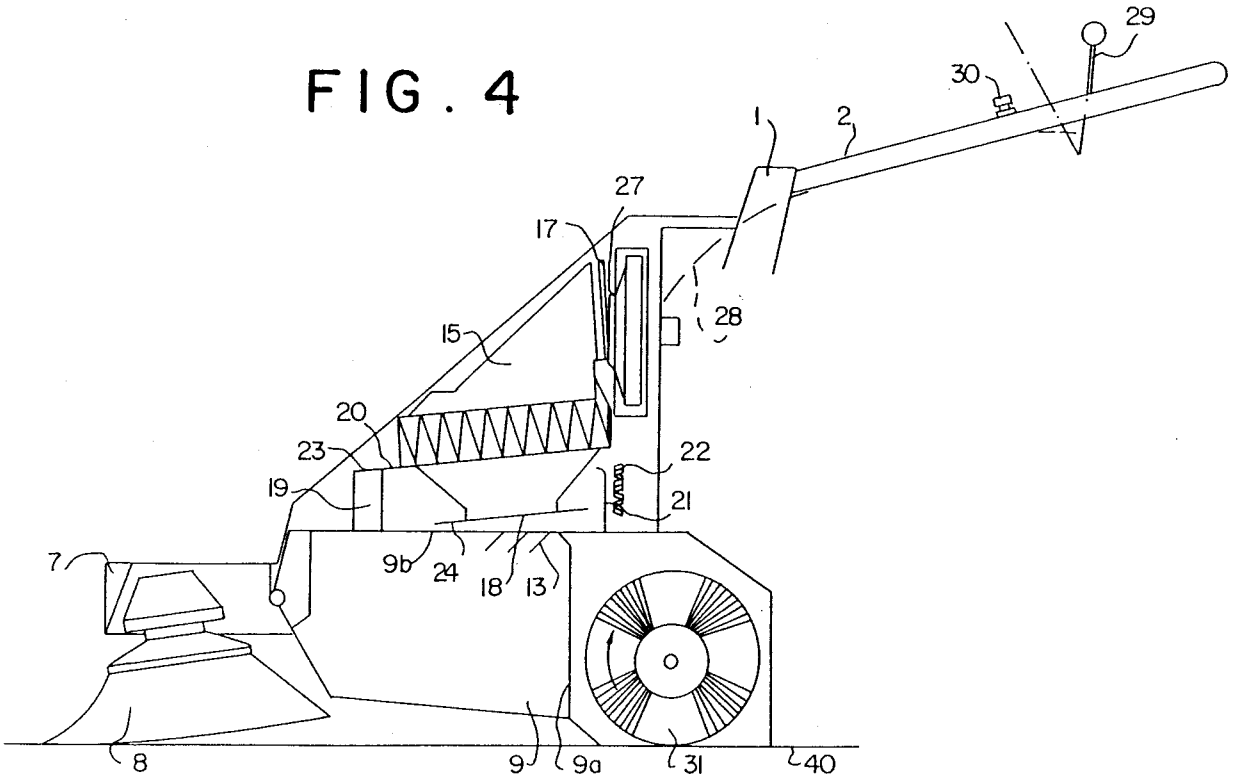
FIG. 4 is a simplified schematic side view of the sweeping machine of FIGS. 1 and 2 with the filter housing in the raised position.

When brush 31 is rotated in a clockwise direction as indicated in FIGS. 3, 4 and 6, dirt and debris on a floor 40 are propelled through rear opening 9*a* into hopper 9. It should be appreciated that brush 31 may also be rotated in a counterclockwise manner to propel dirt from floor 40 over its upper edge through the rear opening 9*a* into hopper 9.

Figure 5:
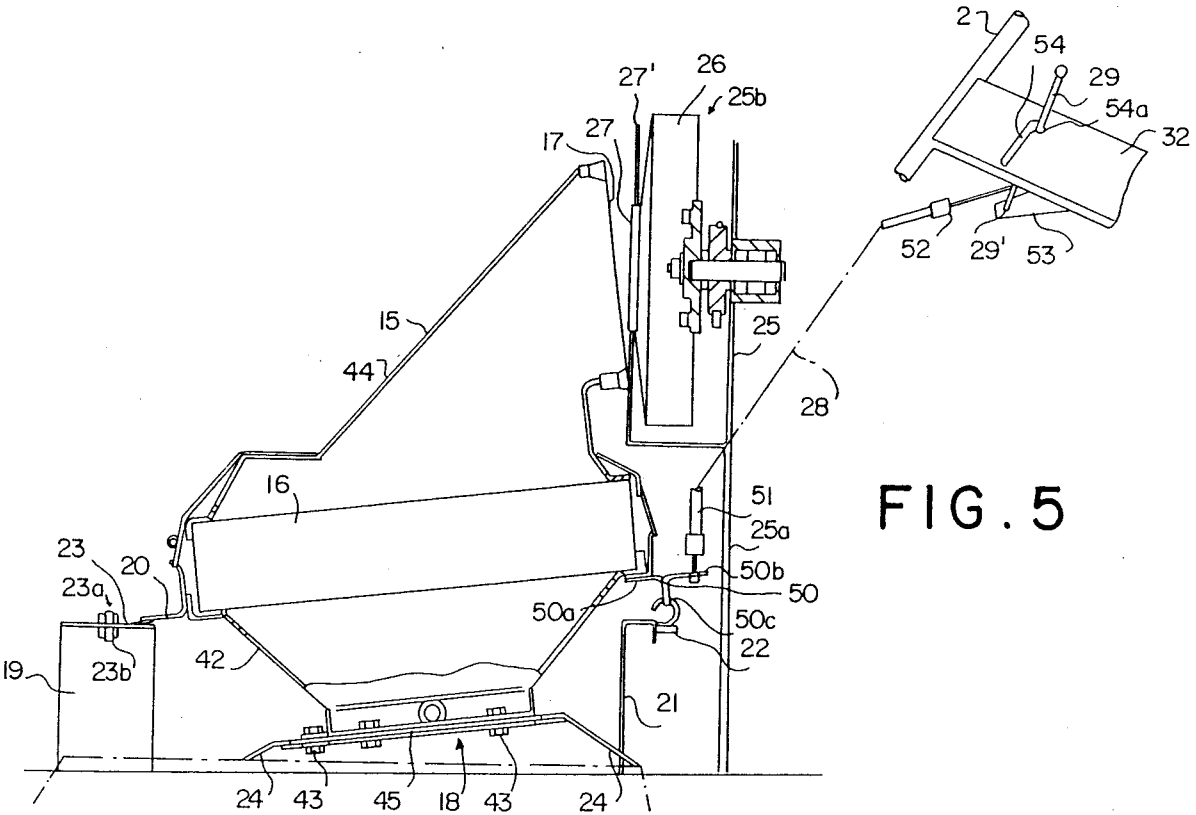
FIG. 5 is a schematic side view of the filter housing in the raised position.

Referring now to FIGS. 2 and 5, blower 26 is suitably mounted within blower housing 25, which suitably includes a rear vertical mounting wall 25*a* in which blower 26 is mounted. Housing 25 suitably includes a blower intake aperture 27, disposed in a forward stationary wall 27'.

Filter housing 15 is disposed to controllably provide a suction flow path from hopper 9 to blower 26, through a conventional filter 16. Referring now to FIG. 5, filter housing 15 suitably comprises lower and upper sections 42 and 44, between which filter 16 is disposed, and an interconnecting peripheral framework 20. Filter 16 is suitably box-shaped and of greater planar dimensions than hopper upper opening 9*b*. A lower peripheral edge of upper section 44 conforms in peripheral shape to, and is received about, filter 16. A filter housing outlet opening 17 is disposed at the other end of housing section 44. If desired, a resilient sealing ring 17*a* can be disposed about the periphery of outlet 17.

Lower section 42 similarly has an upper lip generally conforming in peripheral shape to, and adapted to receive, filter 16. Lower section 42 tapers inwardly to ultimately define a filter housing inlet opening 18 of approximately the dimensions of hopper upper opening 9*b*.

Framework 20, which holds together lower and upper sections 42 and 44, is disposed about the periphery of filter 16 and overlies or is otherwise affixed to portions of both housing sections 42 and 44. When filter housing 15 is installed, outlet 17 is perpendicularly disposed relative to a corresponding filter housing inlet 18 and laterally offset to the rear thereof.

A flanged frame 45 is affixed to lower housing section 42 about inlet 18. Frame 45 suitably includes respective halves, held together by screws 43, between which the periphery of a continuous sealing flap 24, suitably formed of a resilient material such as rubber or flexible plastic, is clamped. Sealing flap 24 extends continuously around inlet 18.

Filter housing 15 is pivotally mounted on support members 19 above hopper 9. A suitable hinging mechanism 23*a* is coupled to a forward edge of framework 20 and fastened, suitably by screws 23*b*, to the tops of supports 19, defining an axis 23 about which filter housing 15 may be tilted. The height of support 19 is such that axis 23 is disposed in a plane generally parallel to the plane of housing inlet 18 at a level approximately halfway between filter housing inlet opening 18 and the lower edge of outlet opening 17. The relative disposition of supports 19 in front of housing 9 is such that the distance of axis 23 from the center of housing inlet 18 is significantly less than the distance to the plane of outlet 17. The distance from axis 23 to the center of inlet 18 is suitably only approximately one-half to two-thirds of the distance from axis 23 to the center of outlet 17. As described below, this facilitates creating a gap between the blower intake and the filter housing outlet while sealing flap 24 remains in contact with hopper upper opening 9*b*.

Strut 21 is mounted on frame 1 on the opposite side of filter housing 15 from supports 19, and is disposed to support housing 15. Filter housing 15 is biased against strut 21 (and blower housing 25) by a conventional tension spring 22. As will be explained, spring 22 cooperates with an actuation mechanism through which the operator can tilt filter housing 15.

Referring again to FIGS. 2 and 5, tilt control lever 29 on handlebar cross strut 32 is connected to filter housing 15 through a suitable actuation mechanism 28, such as, for example, a Bowden cable or a rod. A support plate 53 is disposed on the underside of cross strut 32. Tilt lever 29 is pivotally attached to plate 53, and extends through an L-shaped guiding slot 54. One end 52 of actuation mechanism 28 (e.g. the cable or rod) is coupled to lever 29 between pivot point 29' and cross strut 32. The other end 51 of actuating mechanism 28 is connected to the rear of filter housing 15, suitably through a T-shaped connector plate 50 which is secured to support frame 20 and is connected to spring 22. Connector 50 has a pair of arms 50*a*, 50*b* and a stem 50*c*. Arm 50*a* is secured to filter housing 15. Arm 50*b* is connected to end 51 of mechanism 28, and stem 50*c* is connected to one end of spring 22. When lever 29 is in a rearward position within slot 54, actuating mechanism 28, operating against the bias of spring 22, pulls the rear of filter housing 15 up so that it lifts off from support strut 21 and pivots about axis 23.

Blower 26 generates suction to facilitate pickup of dust and small particles raised by cylindrical brush 31. However, under some operating conditions, suction may not be desirable. For example, if damp dirt, or light granules, e.g., of polystyrene, are to be taken up by the sweeping machine 100, suction may not be desirable. However, it may also be desirable for blower 26 to continue to run. Under some circumstances, it is desirable to interrupt the suction without deactivating blower 26. For example, blower 26 may be employed to assist in cooling the drive mechanism.

Suction control which does not require deactivating blower 26 is provided by moving filter housing 15 into first (untilted) or second (tilted) positions, to selectively provide or break the suction air path between hopper 9 and blower 26. To provide suction, filter housing 15 is disposed in the first (untilted) position (shown in FIGS. 2, 3 and 6). In this position, housing 15 rests on strut 21, with housing inlet 18 generally in registry with hopper upper opening **9*b*, and housing outlet 17 in general registry with blower inlet 27. Sealing ring 17*a* of filter housing 15 surrounding outlet 17 fits against wall 27' of blower housing 25 to create a seal. Likewise, sealing flap 24 (not shown in FIG. 2) provides a seal about hopper upper opening 9*b* and filter housing inlet 18. With filter housing 15 in this position, blower 26 produces a current of air through openings 9*a* and 9*b* of hopper 9, filter housing inlet 18, filter 16, and filter housing outlet 17, and finally through blower 26. Dust and small particles thrown up by brush 31 are collected on filter 16**.

To interrupt suction, filter housing 15 is tilted into the position illustrated in FIGS. 4 and 5, creating a gap between filter housing outlet 17 and the blower intake opening. Referring to FIG. 5, to retain filter housing 15 in the tilted position, operating lever 29 is moved rearwardly in slot 54 until it is engaged in a locking foot **54*a* of the slot and thus maintained in the rearward position. The rearward movement of lever 29 causes actuation mechanism 28 to lift the rear of filter housing 15 against the force of spring 22, tilting housing 15 about axis 23. This causes a generally V-shaped gap to be formed between filter housing outlet opening 17, and intake opening 27 of blower 26, interrupting the closed air path. It should be appreciated that because of the disposition of axis 23, relatively little vertical movement of the rear of housing 15 causes a significant horizontal displacement of the top of housing outlet 17 and intake 27 of blower 26**.

A gap is similarly created between hopper upper opening **9*b* and filter housing inlet 18. Flanged frame 45 assumes a disposition sloping upwardly from the front to the rear. However, given relative disposition of axis 23, the tilting engenders relatively little horizontal displacement, so that housing inlet 18 continues to substantially overlie hopper upper opening 9*b*. Further, while the movement of flanged frame 45 results in deformation of sealing flap 24, sealing flap 24 is sufficiently flexible and elastic and of sufficient dimensions to maintain a sealing contact with the upper wall of hopper 9 circumscribing upper opening 9*b*. Thus, blower 26 remains isolated from the dust and particles raised by brush 31. The gap between filter outlet opening 17 and blower intake opening 27 causes blower 26 to draw air from the surrounding area through the gap, rather than through filter housing 15**. Accordingly, with the closed air path disrupted, there is no suction.

To restore suction, the operator moves operating lever 29 out of locking foot **54*a* of guide slot 54, and filter housing 15, by its own weight and the biasing force of spring 22, returns to the untilted position. Filter housing 15 moves downwardly into its untilted registry position, and at the same time, actuating mechanism 28 causes lever 29 to move forwardly in slot 54**.

Collected dirt can readily be dislodged from filter 16 by moving lever 29 back and forth inside guide slot 54 without engaging locking foot **54*a* of guide slot 54, causing filter housing 15 to correspondingly tilt up and down on axis 23 and strike against strut 21. A sharp shock occurs upon each impact of housing 15 on strut 21, dislodging dirt from filter 16 and causing it to fall through housing inlet opening 18 into hopper 9. Since sealing flap 24 continues to surround and provide a seal between housing inlet 18 and hopper upper opening 9*b*, and housing inlet 18 continues to generally overlie opening 9*b*, blower 26 is effectively isolated from the dust and particles loosened by the bouncing of filter housing 15, and the dislodged particles are received in hopper 9. Further, the forward incline of guide plates 13 direct the dislodged particles towards the front of hopper 9 and away from rear opening 9*a*. Thus, the risk of the dislodged particles escaping through hopper rear opening 9*a*** is reduced.

As previously noted, hopper 9 is mounted between forward side supports **1*a* of machine frame 1, and can be removed from, and reinserted into, sweeping machine 100 from the front. Referring to FIG. 6, projections 11 and 12 on the side walls of hopper 9 cooperate with track guides 35 on each of forward side supports 1*a*. Each track 35 includes a downwardly inclined, front portion 36, a generally horizontal (slightly inclined) middle portion 37, and an upwardly angled end portion 38. Inclined front portion 36 extends downwardly to a distance from the ground which is less than the distance of the lower surfaces of projections 11 and 12 from the bottom of hopper 9. Middle portion 37 of track 35 is disposed at a distance from the ground greater than the distance from projection 12 to the bottom of hopper 9. Inclined front portion 36 includes a projection surface 36*a*, running obliquely forward from the lowest point of front portion 36 and extending upward to a point proximate the junction of front portion 36 with middle portion 37 slightly below the level of middle portion 37. A recess, e.g., gap 36*b*, is thus formed in the vicinity of forward portion 36, and the juncture of track portions 36 and 37, suitably of a distance slightly greater than the diameter of projection 11, but preferably less than the diameter of projection 12. This gap begins at the level of middle portion 37 and gradually decreases in width, so that projection 11** rests therein as shown.

Figures 7, 8:
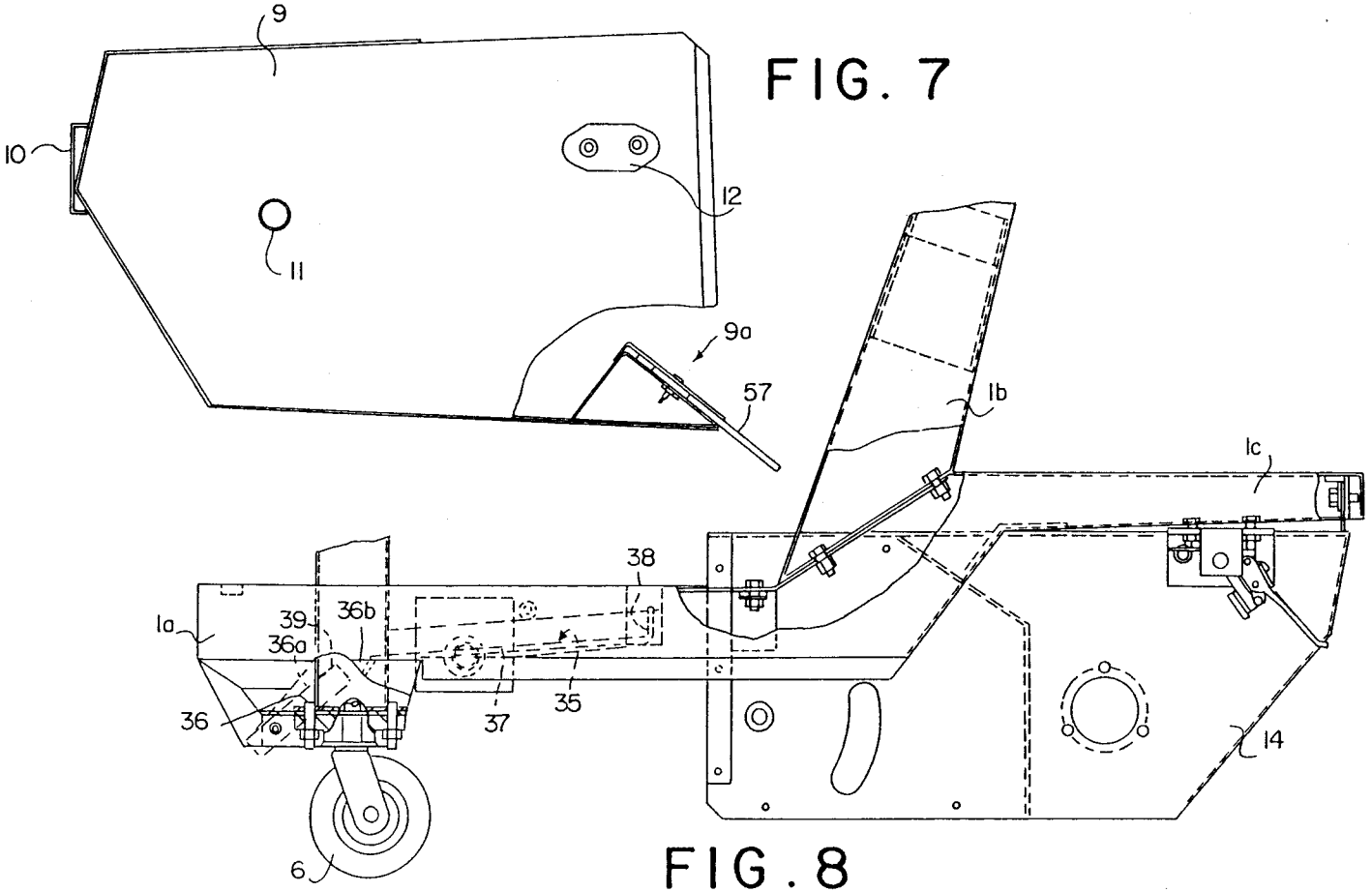
FIG. 7 is a side elevational view, partly broken away, of a hopper according to the invention.
FIG. 8 is a partial side elevational view, partly broken away, of the frame and hopper guide track assembly of FIG. 6.

Referring to FIG. 8, portions 37, 38 of track 35 may comprise a generally Z-shaped rail mounted at one edge to the interior of forward frame portion **1*a*. Forward portion 36 comprises a separate, generally rectangular plate secured face-to-face with the interior of frame portion 1*a*. Surface 36*a* is a side edge of plate 36, and gap 36*b* is a notch defined between a downturned end of rail 37, 38 and an upper edge of plate 36**.

When hopper 9 is received in machine 100, the lower surface of each rear mounting projection 12 is disposed on the corresponding middle portion 37 of the associated track 35, abutting against angled rear portion 38, and each front projection 11 is received in the gap at the juncture of forward portion 36 and middle portion 37 of track 35. Track 35 is disposed so that hopper 9, with projections 11 and 12 engaged in track 35, is disposed off of ground 40 with rear opening 9*a* proximately adjacent brush 31.

Hopper 9 is easily removed for emptying from the front of machine 100 without exposing blower 26 to dust. Arm 7 with disk broom 8, if present, is swung upwards to provide clearance. Hopper 9 is lifted slightly, suitably using grip 10 (See FIG. 2) to cause projection 11 to disengage and clear projection surface 36*a* of guide track 35. Hopper 9 can then be pulled forward, with projection 12 sliding on middle portion 37 of track 35, then over the upper end 39 of surface 36*a*, and then over projection surface 36*a* of front portion 36. Since the dimensions of projection 12 are larger than the gap at the juncture of front portion 36 and middle portion 37, the gap does not hinder smooth removal; projection 12 slides readily over the gap. During removal of the hopper, filter housing 15 is normally in the lowered position (FIGS. 3 and 6) with blower 26 protected from dust by filter 16. As hopper 9 is removed, sealing flap 24 slides over the upper wall of hopper 9.

To reinsert hopper 9, hopper 9 is placed on the ground in front of machine 100. Machine 100 is then moved toward hopper 9, causing projections 12 to engage the front surfaces of corresponding projection surfaces 36*a*, sliding over surfaces 36*a* and into middle portions 37 of guide tracks 35. As projections 12 slide on middle portions 37 toward angled portions 38, forward motion of machine 100, causes projections 11 to ultimately engage surface 36*a* and similarly slide over front track portions 36 until projections 11 slip over projection surfaces 36*a* and enter in the gaps. Projections 12 abut against angled rear portions 38, thus securing hopper 9 in machine 100. As hopper 9 moves rearward and upward on tracks 35, the upper surface of hopper 9 is brought against sealing flap 24, which ultimately again assumes a sealing relationship about upper opening 9*b*.

It will be understood that the above description is of a preferred exemplary embodiment of the present invention, and that the invention is not limited to the specific form shown. Modifications may be made in a design and arrangement of the elements within the scope of the invention as expressed in the appended claims.

We claim:

1. A sweeping machine of the type including:

a rotary brush, a hopper having a first opening for receiving particles propelled by said brush and a second opening;

a blower for generating an airstream through an intake opening thereof;

a filter housing having an inlet opening and an outlet opening;

a filter mounted in the filter housing over the second hopper opening; and means for disposing said filter housing to establish air flow communication between said hopper second opening and said blower intake opening, with said filter housing inlet above said hopper second opening, and said filter housing outlet in close proximity to said blower intake, said machine being improved in that said means for disposing said filter housing comprises:

means for tilting the filter housing about an axis independently of the blower and the hopper, the axis being disposed on the side of said filter housing opposite to said blower intake, and at a distance from the center of said filter housing inlet less than the distance of said axis to the center of said filter housing outlet, the filter housing being disposed, when untilted, to establish said air flow communication between the blower and hopper, and said filter housing being disposed, when tilted, with said outlet removed from close relation with said blower intake to reduce such airflow communication.

2. The sweeping machine of claim 1 wherein the distance of said axis from the center of said housing inlet is within the range of approximately one-half to two-thirds of the distance of said axis from the center of said housing outlet.

3. The sweeping machine of claim 1 wherein said axis is disposed at a height between the level of said housing inlet and the level of said housing outlet.

4. The sweeping machine of claim 1 including means for effecting sealing contact between said housing outlet and said blower intake when said housing is untilted.

5. The sweeping machine of claim 1, wherein said tilting means is disposed to cause said filter housing to move out of close contact with said second opening of said hopper when tilted, said machine further including means, including a flap of resilient material surrounding said housing inlet, for maintaining a sealed, communicating relationship between said housing inlet and said hopper second opening in both tilted and untilted positions.

6. The sweeping machine of claim 5, wherein said machine includes a lower support structure disposed such that said housing rests upon said support structure when in an untilted position, and said means for biasing comprises a tension spring coupled between said housing and said support structure.

7. The sweeping machine of claim 1, further including means for biasing said filter housing into an untilted position.

8. The machine of claim 1 including means for selectively maintaining said housing in said tilted position.

9. The machine of claim 1 further comprising a rearwardly extending handlebar and means, including an operating control disposed on said handlebar, for selectively tilting said filter housing.

10. The machine of claim 9 wherein said means for tilting engages the side of said filter housing closest to said blower.

11. A sweeping machine, comprising:

a machine frame movably supported on wheels, a rotary brush for sweeping up particles of debris, which brush is mounted on the underside of the machine frame;

a hopper having a first opening for receiving particles propelled by the brush and a second opening in the top thereof;

a blower which generates an inward air-stream through an intake opening thereof;

a filter housing having an inlet opening and an outlet opening, the filter inlet opening being disposed to communicate with the second opening of the hopper and the filter outlet opening being disposed to communicate with the blower intake opening so as to establish air flow communication between the hopper and the blower;

a filter mounted in the filter housing to prevent particles of debris from the hopper from being drawn into the blower;

a filter housing mounting assembly which allows the filter housing to reciprocate independently of the hopper and blower between a first position in which air flow between said hopper and said blower is established and a second position wherein said filter housing outlet is moved out of close proximity with said blower intake, substantially interrupting air flow between said hopper and said blower;

a filter housing control device; and an actuation mechanism connected to the filter housing and the control device for reciprocating the filter housing in response to manipulation of the control device.

12. The machine of claim 11, further comprising guide track means on said machine frame for slidably receiving said hopper beneath said filter housing, said hopper having pairs of oppositely directed projections on respective side walls thereof, which projections slidingly engage said guide track means.

13. The machine of claim 12, wherein said guide track means comprises a pair of elongated projections disposed on the inner surface of said machine frame, each projection having a substantially vertical inner end portion, a substantially horizontal middle portion, and a downwardly inclined outer end portion.

14. The machine of claim 11, wherein the control device comprises a manually-operable lever.

15. The machine of claim 14, wherein the actuation mechanism comprises a cable secured to the filter housing and the lever for moving the filter housing in unison with the lever.

16. The machine of claim 14, further comprising a rearwardly extending handlebar for manually guiding the machine, the lever being mounted on the handlebar.

17. The machine of claim 11, wherein the filter housing mounting assembly includes a spring disposed to resiliently bias the filter housing to its first position.

18. The machine of claim 11, wherein the filter housing mounting assembly includes a hinge defining an axis about which the filter housing tilts during its reciprocation between its first and second positions.

19. A sweeping machine of the type including a machine frame movably supported on wheels, said machine frame having mounted thereon a rotary brush, a hopper having a first opening for receiving particles propelled by said brush and a second opening in the top thereof, a blower for generating an air-stream through an intake opening thereof, a filter housing having an inlet opening and an outlet opening, and means for disposing said filter housing to establish air flow communication between said hopper second opening and said blower intake opening, with said filter housing inlet above said hopper second opening, and said filter housing outlet in close proximity to said blower intake, said machine being improved in that:

said means for disposing said filter housing comprises means for reciprocating said filter housing over a short distance within said machine between a first position in which air flow between said hopper and said blower is established and a second position wherein said filter housing outlet is moved out of close proximity with said blower intake, substantially interrupting air flow between said hopper and said blower, wherein such reciprocating means includes a lever, a connector secured to the filter housing, a cable for transmitting motion of the lever to the connector to move the filter housing, and a spring secured to the machine frame and the connector at opposite ends thereof for biasing the filter housing to its first position.

* * * * *